United States Patent [19]

Lovrekovic et al.

[11] 4,253,233

[45] Mar. 3, 1981

[54] RAPIDLY FORMED ELECTRICAL CONNECTION

[75] Inventors: Steven N. Lovrekovic, Cleveland; Harry J. Bowers, Jr., Mayfield Heights, both of Ohio

[73] Assignee: General Electric Company, Schenectady, N.Y.

[21] Appl. No.: 35,932

[22] Filed: May 4, 1979

[51] Int. Cl.[3] ..... H01R 43/00

[52] U.S. Cl. ..... 29/857

[58] Field of Search ..... 29/628; 83/465, 382; 315/185 R, 185 S; 362/11, 12, 252, 806; 339/97 L, 99 L

[56] References Cited

U.S. PATENT DOCUMENTS

| | | | |
|---|---|---|---|
| 3,148,009 | 9/1969 | Abramson | 339/99 L |
| 3,404,453 | 10/1968 | Moranduzzo | 29/628 |
| 3,595,116 | 7/1971 | Gilbert | 83/465 |
| 3,609,643 | 9/1971 | Connan | 339/97 L |
| 3,968,398 | 7/1976 | Lehman . | |
| 4,028,798 | 6/1977 | Bechard et al. . | |

*Primary Examiner*—Francis S. Husar
*Assistant Examiner*—C. J. Arbes
*Attorney, Agent, or Firm*—Norman C. Fulmer; Lawrence R. Kempton; Philip L. Schlamp

[57] ABSTRACT

An electrical accessory having a lead is connected to an electrical cord having a multi-strand conductor by placing the cord and the lead against a backing member. A tool member vibrated at an ultrasonic frequency is brought into engagement with the electrical cord. Insulative material surrounding the conductor is melted and displaced away from the tool member. The conductor is driven against the lead and the lead is driven into the surface of the backing member. Upon de-energization of the tool member, the displaced insulative material solidifies and secures the connection between the conductor and the lead.

The tool member includes a tip from which a sharpened projecting portion extends. The projecting portion severs the conductor in those instances where the conductor is to be connected to spaced leads. Serrated driving surfaces are positioned on either side of the projecting member. The serrations minimize excessive displacement of the strands of the conductor during the attachment process and provide a place for insulative material to go so that a good connection between the conductor and the leads can be obtained.

22 Claims, 9 Drawing Figures

RAPIDLY FORMED ELECTRICAL CONNECTION

CROSS-REFERNCE TO RELATED PATENTS AND APPLICATIONS

1. METHOD OF MAKING ELECTRICAL CONNECTIONS, U.S. Pat. No. 4,028,798, issued June 14, 1977 to Conrad E. Bechard et al, here the "Electrical Connection Patent," the dislosure of which is incorporated by reference.
2. FUSED DECORATIVE STRING SET, U.S. Pat. No. 3,968,398, issued July 6, 1976 to Louis E. Lehmann and Ralph J. Luft, here the "String Set Patent," the disclosure of which is incorporated by reference.
3. SOCKET FOR ELECTRICAL CONNECTION, U.S. Pat. Application Ser. No. 35,931, filed concurrently by J. C. Perusek, here the "Clamshell Socket Patent," the disclosure of which is incorporated by reference.

BACKGROUND OF THE INVENTION

1. Field of the Invention

The present invention relates generally to techniques for forming electrical connections and, more particularly, to a method and apparatus for attaching electrical accessories to electrical cords at very high speeds.

2. Description of the Prior Art

Various techniques have been proposed for connecting an electrical accessory to an electrical conductor included as part of an electrical cord. A common attachment technique is to strip the insulation from a portion of the conductor and secure the exposed conductor to an electrically conductive portion of the accessory. For convenience, electrically conductive portions of accessories hereafter will be referred to as electrical leads. In the case of an accessory such as a miniature lamp used in decorative string sets, these leads typically take the form of thin, to elongated, easily bent wire.

The connection between the conductors and the leads commonly is made by crimping the leads and the conductors together, by soldering, or by clamping through the use of various fasteners. These conventional techniques have certain drawbacks. A certain amount of effort is required to strip the insulative material from the conductor. Thereafter, the conductors and the leads must be aligned and a suitable fastening process carried out. Because the leads often are easily bent, they must be handled with care during the connection process. Moreover, if the conductor is made of multiple strands, the conductor also must be handled carefully to avoid damage to the individual strands. With respect to decorative string sets, it is not unusual for as many as eight separate steps to be required to properly and reliably connect a miniature lamp to an electrical cord.

In order to overcome the time-consuming steps associated with assembly of such string sets, specially configured sockets and plug-in lamp bases have been designed. An effective design of this type is shown in the String Set Patent. Even in the String Set Patent, however, a certain amount of assembly time is required to strip the conductors and assemble them into a specially configured socket. In short, although proposals such as the String Set Patent permit relatively easy connection of the conductors and the leads, the basic problem of numerous assembly steps still exists.

A different approach has been suggested in the Electrical Connection Patent. There, an electrical conductor was carried on the surface of an insulative member such as a circuit board. Because the conductor was carried on the surface of the circuit board, the conductor was exposed. Accordingly, no insulative material needed to be stripped from the conductor in order to have access to the conductor. In one embodiment, an electrical lead was placed on the opposite side of the circuit board from the conductor and the electrical lead was driven and bent sideways into and through the circuit board to cause the lead to engage and make electrical contact with the underside of the conductor. In another embodiment, the lead was placed on the same side of the circuit board as the conductor and spaced portions of the lead were driven into the circuit board such that an intermediate portion of the lead came into contact with the conductor. These results were brought about by employing a heated or ultrasonically vibrated tool member which not only engaged the lead, but also displaced portions of the circuit board in the region of the tool member. After electrical contact between the lead and the conductor was established, the tool member was withdrawn and portions of the lead remained embedded in the insulative member.

Although the foregoing technique as described in the Electrical Connection Patent has been highly successful, it still has not addressed certain problems. For example, the patent does not describe how the technique could be used to attach an accessory to an electrical cord. Although the patent at column 7, lines 55–59 states that the invention "is useful for attaching a variety of types of wires, strips, and the like to a conductor carried by a deformable insulative member such as being carried on its surface or embedded within it," the invention clearly is directed to a circuit board-type construction where the conductor is on the surface of the circuit board. There is no suggestion or teaching that the technique could be applied to connect leads to electrical cords per se.

SUMMARY OF THE INVENTION

The present invention overcomes various drawbacks associated with prior art connection techniques. The invention completely obviates problems relating to stripping insulative material from electrical conductors and subsequent problems in joining the conductors to electrical leads.

In accordance with the preferred practice of the present invention, electrical leads of an accessory are placed adjacent a backing member. An electrical cord consisting of an electrical conductor surrounded by insulative material is placed against the electrical leads. Thereafter, the electrical cord is engaged by an energized tool member which melts and displaces the insulative material and drives the electrical conductor and the leads into firm engagement with each other. During this process, the insulative material is melted in the region of the tool member and is forced away from the tool member. Upon de-energization of the tool member, the displaced insulative material solidifies and supports the backing member, leads, and conductor in an integral assembly.

In a preferred embodiment, the accessory is an electric lamp included as part of a decorative string set. If the string set is to be series-connected, the electrical cord can be formed by taking a single strand of conductor and bending it back upon itself. In effect, a cord having two conductors is formed. The backing member is formed of a thermoplastic, insulative material and the electrical leads of the lamp are placed against the backing member. Thereafter, one of the conductors of the string set is placed atop the electrical leads. The tool member includes a projecting portion adapted to sever the conductor at a point intermediate the electrical leads. Accordingly, upon melting and subsequent displacement of the insulative material, the severed ends of the conductor are brought into engagement with the spaced leads. By this technique, current can flow into the lamp through one of the leads and out of the lamp through the other lead, while the lamp is attached to only one conductor. A plurality of lamps can be connected to either one of the conductors by disposing backing members and lamps at spaced locations along the length of the electrical cord.

In order to insure a good electrical connection between the severed ends of the conductor and the spaced electrical leads, the tool member includes specially configured driving surfaces. The driving surfaces are positioned on either side of the projecting member. The driving surfaces are serrated, and the serrations preferably are positioned perpendicular to the longitudinal axis of the conductor. This accomplishes two main functions:

(1) The "peaks" of the serrated portions penetrate the insulative material and firmly clamp the conductor against the leads; and (2) The "valleys" of the serrated portions receive melted insulative material, thus permitting insulative material to be displaced away from the point of contact between the conductor and the leads.

The first-mentioned objective is important because the conductor typically will be a multi-strand conductor composed of very fine copper wires. When the insulative material suddenly is melted and as the conductor is driven against the leads, the individual strands tend to separate and this can lead to a poor electrical connection. The peaks of the serrated surface minimize displacement of the conductor at this critical point in the process.

The second-mentioned objective is important because the insulative material is melted so rapidly and the conductor is driven against the leads so rapidly that it is difficult to displace the insulative material away from the point of contact between the conductor and the leads. The valleys of the serrated surface provide a place for the insulative material to go at this point in the attachment process. It will be appreciated that the particular configuration of the tool member, accordingly, represents a significant feature of the invention.

An advantage realized from the invention is that electrical accessories can be attached to electrical cords exceeedingly rapidly, without the need for separate conductor-stripping and conductor-lead attaching steps. Moreover, fasteners and solder no longer are needed. In the particular environment of a decorative string set, electric lamps now can be attached to electrical cords in one process step, whereas previous techniques required up to eight process steps. It is expected that up to 20 lamps can be attached to a 15-foot length of conductor within 15 seconds, This is a repeatable production rate far exceeding that of any presently known attachment technique. These advantages and a fuller understanding of the present invention may be had by referring to the following description and claims, taken in conjunction with the accompanying drawings.

DESCRIPTION OF THE PREFERRED EMBODIMENT

Figure 1:
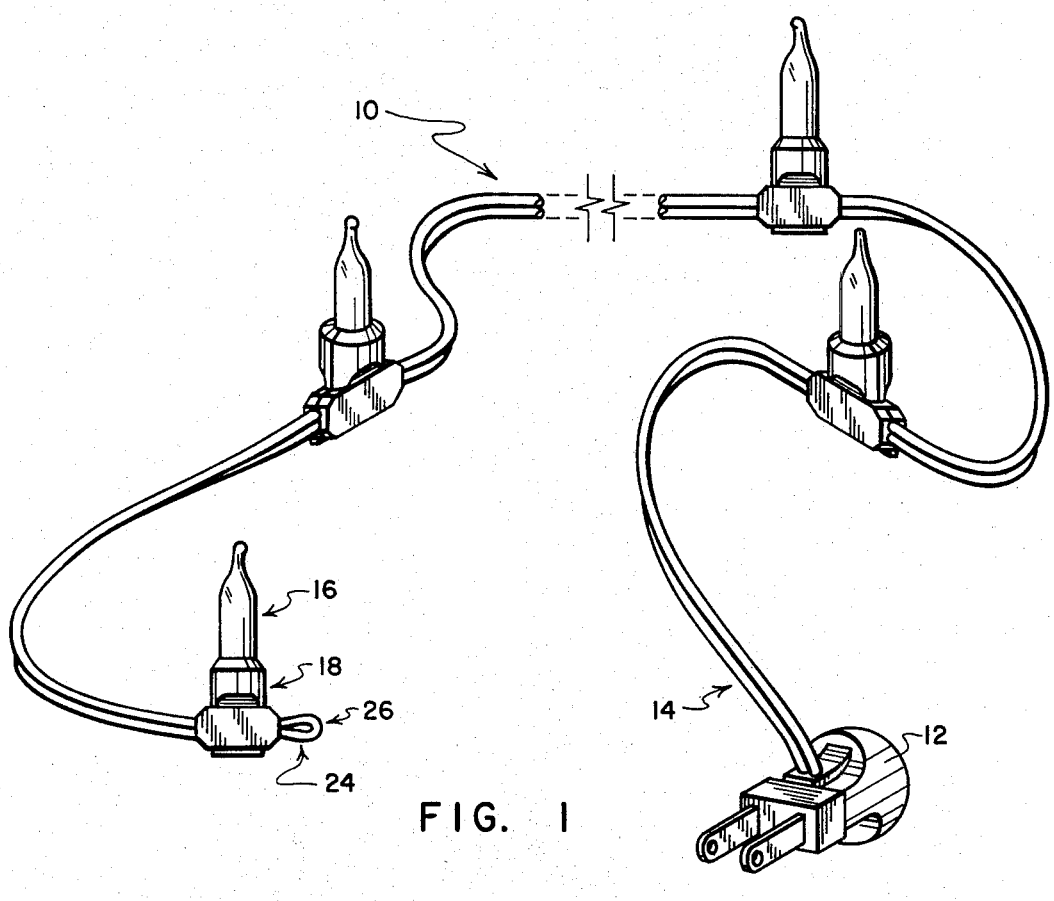
FIG. 1 is a view of a decorative string set produced in accordance with the present invention.

A decorative string set 10, of the type used for Christmas tree decoration, is shown in FIG. 1. The string set 10 partially is manufactured in accordance with the present invention and includes an electrical plug 12, an elongate electrical cord 14, and a plurality of incandescent lamps 16. Each lamp 16 is surrounded at its base by a socket 18. The socket 18 is disclosed and claimed in the Clamshell Socket Patent.

The string set 10 draws very little electrical current due to the series-connected low voltage lamp filmaments. The other components of the string set 10 accordingly are smaller and lighter than otherwise would be possible. For example, the electrical cord 14 includes a pair of multi-strand conductors 20. Conductors 20 may be as light as 24 gauge.

The conductors 20 are surrounded by an insulative, thermoplastic material 22. The conductors 20 with their surrounding insulative material 22 may be referred to as a string 24. The cord 14 is formed by taking a given length of string 24 and bending one of the insulated conductors back upon itself as at 26.

The lamps 16 are series-connected. Referring now to FIGS. 2–7, this is achieved by severing one of the conductors 20 and connecting the severed ends to the lamp 16. Each lamp 16 includes a transparent bulb 30 within which a coiled filmament 32 is disposed. The filament 32 is secured within the bulb 30 by legs 34, 36 which are held together by a bead 38. In order to maintain a series connection upon failure of the filament 32, the legs 34, 36 are connected by a shunt 40. In the embodiment illustrated, the shunt 40 comprises a length of aluminum wire wound about the legs 34, 36. Shunt 40 is of sufficiently low electrical resistance that it will not glow like the filament 32; however, it will continue to conduct electricity and maintain the string set 10 in an operative condition upon failure of the filament 32. A pair of spaced lead wires 42, 44 are connected to the legs 34, 36, respectively. The lead wires 42, 44 extend at one end into the bead 38. The other end of the lead wires 42, 44 extend into a base seal region 46 of the bulb 30. The lead wires 42, 44 extend outwardly of the base seal region 46 and are bent back upon themselves to form multi-part leads 42*a*, 42*b* and 44*a*, 44*b* extending outwardly of the lamp 16. As will be explained subsequently, the multi-part leads help to insure that a good electrical connection will be made with the conductor 20.

The socket 18 includes a backing member 50 connected to a facing member 52 by a hinge 54. The socket 18 is formed in an injection molding process from a thermoplastic resin such as that known by the trademark CYCOLAC. For purposes of the present invention, it is important only that the backing member 50 be formed of a material which can be melted and solidified without destroying its insulative and structural properties. The backing member 50 includes a relatively flat, rectangular base region 56 from which a semi-cylindrical portion 58 projects. The semi-cylindrical portion 58 is connected to the base region 56 by a transition portion 60. The base region 56 is shaped appropriately to support the lead wires 42, 44 and the electrical cord 14 at right angles to each other. The semi-cylindrical portion 58 is configured to provide support for the bulb 30.

ATTACHMENT OF THE LAMP 16 TO THE CORD 14

Figure 2:
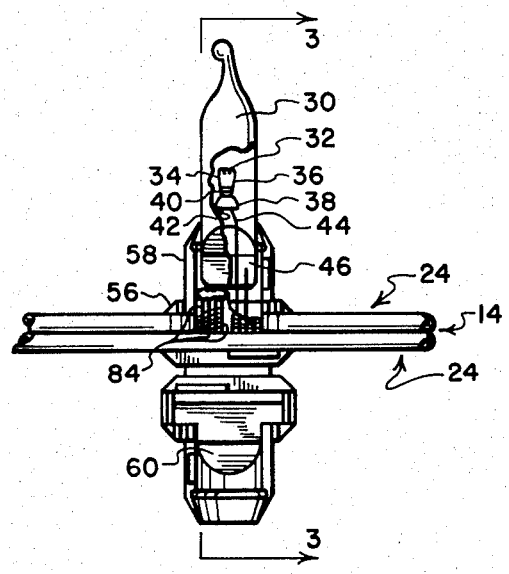
FIG. 2 is an elevational view of a lamp attached to an electrical cord by the technique according to the invention.
Figure 3:
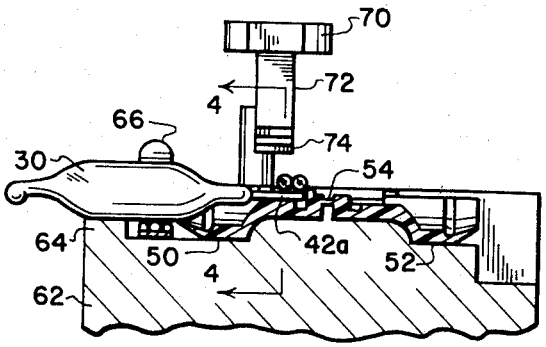
FIG. 3 is a cross-sectional view taken along line 3—3 of FIG. 2, showing a backing member, lamp, and electrical cord immediately prior to being connected.
Figure 4:
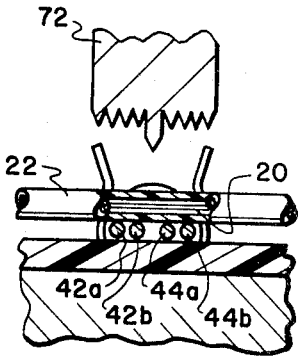
FIG. 4 is an enlarged cross-sectional view taken along line 4—4 of FIG. 3.
Figure 6:
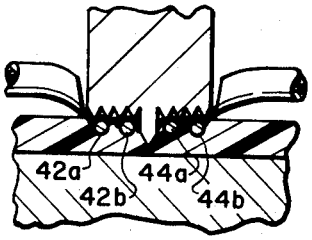
FIG. 6 is an enlarged cross-sectional view taken along line 6—6 of FIG. 5.
Figure 5:
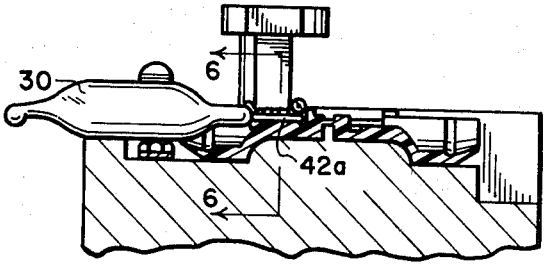
FIG. 5 is a view similar to FIG. 3, in which a tool member has engaged the conductor and is driving the conductor sideways against the electrical lead.
Figure 7:
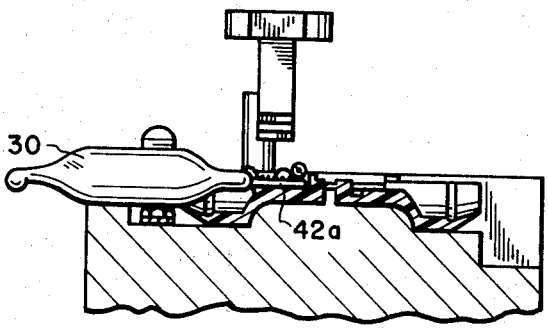
FIG. 7 is a view similar to FIG. 3, in which the tool member has been retracted, leaving the electrical conductor and lead connected in an integral assembly.
Figure 8:
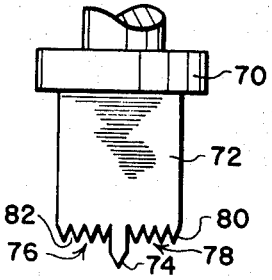
FIG. 8 is a side elevational view of a preferred form of an ultrasonic tip usable with the invention.
Figure 9:
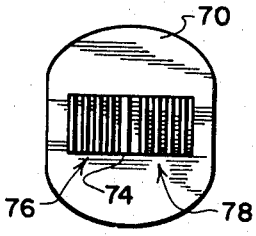
FIG. 9 is an end view of the ultrasonic tip of FIG. 8.

Attachment of the lamp 16 to the cord 14 will be explained by reference to FIGS. 3–7. Assembly is carried out as follows:

1. An open socket 18 is placed atop an anvil 62. The anvil 62 is shaped on its upper surface to support the opened socket 18 largely in surface-to-surface contact. The anvil 62 includes a projecting portion 64 against which a portion of the lamp 16 is supported during assembly. The anvil 62 also includes a clip 66 positioned intermediate the projecting portion 64 and the center of the anvil 62.
2. The lamp 16 is placed atop the anvil 62 such that the bulb 30 is in contact with curved portion 64 and so that the bulb 30 is grasped by the clip 66. The clip 66 is flexed slightly upon placement of the lamp 16 into that position shown in the FIGURES. The leads 42, 44 are positioned such that they are adjacent to, and superimposed above, the rectangular base region 56.
3. The cord 14 is placed atop the leads 42, 44 and is extended across the base region 56 from one side of the base region to the other. In this position, the leads 42, 44 and the cord 14 are at right angles to each other.
4. A tool member 70 is brought into engagement with the cord 14. The tool member 70 includes a tip 72 from which a sharpened projecting portion 74 extends. Driving surfaces 76, 78 are disposed on either side of the projecting portion 74. This construction is shown best in FIGS. 8 and 9. The driving surfaces 76, 78 are serrated and include a plurality of peaks 80 and valleys 82 extending from one side of the driving surfaces to the other.
5. The tool member 70 is vibrated at an ultrasonic frequncy and is advanced into engagement with the cord 14. As shown best in FIGS. 3 and 5, the tip 72 engages only one of the conductors 20.
6. The sharpened edge of the projecting portion severs the conductor 30 at a location intermediate the leads 42*a* and 44*a*. Substantially simultaneously, the energy imparted to the insulative material 22 causes the material 22 to melt.
7. As the tool member 70 is advanced further toward the anvil 62, the peaks 80 of the driving surfaces 76, 78 engage the individual strands of the now-severed ends of the conductor 20 and prevent the strands from being displaced excessively. Orienting the serrations at right angles to the longitudinal axis of the conductor assists in clamping the individual strands. The tool member 20 performs a driving and bending function with respect to the strands of the conductor 20, bringing the strands into electrical contact with the leads 42, 44. Because the leads 42, 44 are bent back to form individual leads 42*a*, 42*b*, 44*a*, 44*b*, the chances of obtaining good electrical contact are enhanced.
8. As the tool member 70 is advanced even further, the backing member 50 is melted locally such that the leads 42, 44 are driven a small distance into the backing member 50. During this process, the valleys 82 of the driving surfaces 76, 78 are filled with molten insulative material which otherwise might interfere with the electrical contact between the conductor 20 and the leads 42, 44. This is indicated in FIG. 2 by the numeral 84. The ends of the conductor 20 are driven into the backing member 60; the projecting portion 74 is wide enought that the ends are separated sufficiently to avoid arcing.
9. While in the position shown in FIGS. 5 and 6, the tool member 70 is de-energized and the components are permitted to rest for a short time to permit molten insulative material to solidify. After the material has solidified, the tool member 70 is retracted to that position shown in FIG. 7 and the lamp 16 will be securely attached to the cord 14 and backing member 50 in an integral, permanent assembly. Thereafter, the lamp unit 16 can be removed from the anvil 62 for further processing as explained more fully in the Clamshell Socket Patent. The above-described severing of the conductor 20 by the projecting portion 74 in manufacturing step number 6 is not necessary when attaching the last lamp 16, because one of the insulated conductors 20 is bent back at 26 and its end is aligned in spaced relationship with the end of the other conductor 20 where the last lamp 16 is to be attached.

It will be appreciated that the present invention provides an extremely simple and quick technique for attaching an electrical accessory to an electrical cord. For the particular electrical accessory illustrated here, the invention reduces the previous multi-step process to essentially a one-step ultrasonic weld. Even though the present invention has been described with reference to a lamp unit having two spaced leads, it will be apparent that other accessories could be attached to an electrical cord by using the teachings of the present invention.

In the particular environment of a decorative string set, the present invention yields surprising advantages. The assembly technique is sufficiently inexpensive that the entire string set 10 can be produced at very low cost. Due to the inexpensiveness of the string set 10 and the permanent nature of the attachment between the lamp 16 and the cord 14, the entire string set 10 can be discarded after a certain number of the lamps 16 have failed. This represents an entirely new concept in decorative string sets.

Although the invention has been described in its preferred form with a certain degree of particularity, it is understood that the present disclosure of the preferred embodiment has been made only by way of example and that various changes in the details of construction may be resorted to without departing from the true spirit and scope of the invention as hereafter claimed. It is intended that the patent shall cover, by suitable expression in the appended claims whatever features of patentable novelty exist in the invention disclosed.

What is claimed is:

1. A method of connecting in electrical communication an electrically conductive member to an electrical conductor, the conductor being surrounded by a thermoplastic, electrically insulative material, comprising the steps of:

(a) placing the conductive member adjacent to an electrically insulative backing member;

(b) placing the conductor adjacent to the conductive member;

(c) melting a portion of the surrounding insulative material of said conductor;

(d) driving the conductive member and the conductor into engagement with each other, the melting of the surrounding insulative material being sufficient to permit such engagement to occur; and (e) solidifying the melted portions of the insulative material, whereby the backing member, the conductive member, and the conductor are secured in an integral, electrically conductive assembly.

2. The method of claim 1, wherein the steps of melting and driving are carried out by a tool member provided with a driving surface which engages a portion of the surrounding insulative material.

3. The method of claim 2, wherein the tool member is caused to vibrate at an ultrasonic frequency.

4. The method of claim 2, wherein the driving surface is provided with extending portions, and including the step of causing said extending portions to penetrate the insulative material and engage the conductor to minimize movement of the conductor during the melting and driving steps.

5. The method of claim 4, wherein the portions which penetrate the insulative material are formed to comprise serrations.

6. A method of connecting an electrically conductive member to a conductor, the conductor being surrounded by an electrically insulative material, comprising the steps of:

(a) placing the conductive member against an electrically insulative backing member;

(b) placing the insulated conductor against the conductive member to compress the conductive member against the backing member;

(c) driving and bending one or more portions of the conductor through the surrounding insulative material toward the conductive member;

(d) continuing driving and bending one or more portions of the conductor until electrical contact between the conductor and the conductive member is attained; and (e) securing the now-contacting conductive member and conductor to each other and to the backing member to form an integral connection.

7. The method of claim 6, wherein the step of driving and bending is carried out by a tool provided with driving surface which engages a portion of the surrounding insulative material, the driving surface forming an opening in the insulative material and causing the material to deform so as to flow around and embed a portion of the conductive member, the embedment thus obtained securing the conductive member and the conductor to each other and to the backing member.

8. The method of claim 7, wherein the tool is caused to vibrate at an ultrasonic frequency.

9. The method of claim 7, wherein the driving surface is provided with serrated portions, the serrated portions minimizing displacement of the conductor during the driving and bending step.

10. The method of claim 6, wherein the step of driving and bending is accomplished by engaging the surrounding insulative material with a tool member, the tool member imparting sufficient energy to the insulative material that the material melts and flows away from the tool member, the molten insulative material solidifying upon tool member deenergization so as to secure the backing member, the conductive member, and the conductor into an integral, electrically conductive assembly.

11. A method for quickly connecting an electrical assessory having spaced leads to an elongate conductor such as that included as part of a conventional electrical cord, the conductor being surrounded by a thermoplastic, electrically insulative material, comprising the steps of:

(a) placing the spaced leads against an electrically insulative backing member;

(b) placing the conductor against the spaced leads;

(c) severing the conductor at a location intermediate the spaced leads;

(d) melting a portion of the electrically insulative material at locations adjacent the spaced electrical leads;

(e) driving the severed ends of the conductor into engagement with the spaced electrical leads, the molten insulative material being displaced while the driving step is being accomplished; and (f) solidifying the melted insulative material before the ends of the conductor and the leads can be moved with respect to each other, the step of solidifying thereby securing the backing member, the conductor, and the spaced leads in an integral, electrically conductive assembly.

12. The method of claim 11, wherein the steps of severing, melting, and driving are carried out by a tool member, the tool member being provided with a projecting portion for severing the conductor, the tool member also including spaced driving surfaces, the driving surfaces being engageable with the severed ends of the conductor to melt the insulative material and drive the ends of the conductor into engagement with the spaced leads.

13. The method of claim 12, wherein the tool member is caused to vibrate at an ultrasonic frequency.

14. The method of claim 12, wherein the driving surfaces are provided with serrations of sufficient sharpness and depth to:

(a) firmly engage the conductor while the insulative material is in a molten state to minimize displacement of the conductor during the driving step; and (b) permit molten insulative material to flow away from the conductor and the leads to insure direct contact between the conductor and the leads without any intervening insulative material.

15. The method of claim 11, wherein the backing member is formed of a thermoplastic substance which is caused to be melted and solidified at spaced regions during the melting and solidifying steps.

16. The method of claim 11, wherein the cord comprises a length of insulated conductor and comprising the steps of bending the insulated conductor back upon itself, and connecting the ends of the conductor to an electrical plug.

17. A method of assembling a string set such as that used to decorate Christmas trees, wherein a plurality of lamps are attached to an elongate, insulated conductor, comprising the steps of:

(a) placing a backing member in a predetermined position;

(b) placing an electric lamp adjacent to the socket member, the electric lamp including spaced electrical leads extending outwardly of the lamp, the leads being positioned against the backing member;

(c) placing an electrical cord against the spaced leads of the lamp, the electrical cord including two insulated conductors;

(d) severing one of the conductors at a location intermediate the spaced leads;

(e) melting a portion of the insulative material surrounding the conductor, the melting taking place at or near the severed ends of the conductor;

(f) pressing the ends of the conductor into engagement with the spaced leads while the insulative material is in a molten state, the leads thereby being pressed into engagement with the backing member; and (g) solidifying the molten insulative material, the solidification occurring sufficiently rapidly that the engagement between the conductor and the leads is maintained.

18. The method of claim 17, wherein the steps of severing, melting, and pressing are carried out by a tool member provided with a driving surface engageable with the outer surface of the electrical cord.

19. The method of claim 18, wherein the tool member is caused to vibrate at an ultrasonic frequency.

20. The method of claim 18, wherein the driving surface is provided with serrations of sufficient sharpness and depth to:

(a) firmly engage the conductor while the insulative material is in a molten state to minimize displacement of the conductor during the driving step; and (b) permit molten insulative material to flow away from the conductor and the leads to insure direct contact between the conductor and the leads without any intervening insulative material.

21. The method of claim 18, wherein the backing member is caused to be formed of a thermoplastic substance which is melted and solidified at spaced regions during the metling and solidifying steps.

22. The method of claim 17, wherein the cord comprises a length of insulated conductor and comprising the steps of bending the insulated conductor back upon itself, and connecting the ends of the conductor to an electrical plug.

* * * * *